US008356573B1

(12) United States Patent
Lesko et al.

(10) Patent No.: US 8,356,573 B1
(45) Date of Patent: Jan. 22, 2013

(54) SHUTTERLESS, INSTANT RADIATION DEVICE FOR CURING LIGHT CURABLE FLOOR COATINGS

(75) Inventors: Robert Lesko, Franklin, NJ (US); Daniel Dayon, Vernon, NJ (US)

(73) Assignee: HID Ultraviolet, LLC, Sparta, NJ (US)

( * ) Notice: Subject to any disclaimer, the term of this patent is extended or adjusted under 35 U.S.C. 154(b) by 490 days.

(21) Appl. No.: 12/409,083

(22) Filed: Mar. 23, 2009

Related U.S. Application Data

(60) Provisional application No. 61/038,940, filed on Mar. 24, 2008.

(51) Int. Cl.
*B05C 9/08* (2006.01)

(52) U.S. Cl. ..... 118/620; 118/641; 118/642

(58) Field of Classification Search ..... 250/504 R; 427/519, 498, 493; 118/620
See application file for complete search history.

(56) References Cited

U.S. PATENT DOCUMENTS

| | | | | |
|---|---|---|---|---|
| 4,241,255 | A * | 12/1980 | Sugiyama et al. | 250/504 R |
| 4,455,510 | A | 6/1984 | Lesko | 315/263 |
| 4,999,216 | A * | 3/1991 | Gaske et al. | 427/519 |
| 5,240,746 | A | 8/1993 | O'Connell | 427/510 |
| 6,096,383 | A * | 8/2000 | Berg et al. | 427/493 |
| 6,245,392 | B1 * | 6/2001 | Hillenbrand | 427/498 |
| 6,468,350 | B1 * | 10/2002 | Hillenbrand | 118/620 |
| 6,538,258 | B1 * | 3/2003 | Rau et al. | 250/504 R |
| 6,761,127 | B2 * | 7/2004 | Field et al. | 118/620 |
| 6,764,719 | B2 * | 7/2004 | Russell et al. | 427/393.5 |
| 7,339,330 | B2 * | 3/2008 | Brates et al. | 315/289 |
| 2002/0140381 | A1 | 10/2002 | Golkowski et al. | 315/363 |
| 2002/0175299 | A1 * | 11/2002 | Kanie et al. | 250/504 R |
| 2003/0124339 | A1 * | 7/2003 | Field et al. | 428/323 |
| 2003/0159308 | A1 * | 8/2003 | Field et al. | 34/275 |
| 2006/0099351 | A1 * | 5/2006 | Field et al. | 427/487 |
| 2007/0200505 | A1 | 8/2007 | Gao et al. | 313/637 |
| 2008/0090193 | A1 | 4/2008 | Soanes | 432/45 |
| 2009/0314966 | A1 | 12/2009 | Garcia | 250/504 H |
| 2010/0171436 | A1 | 7/2010 | DeVincentis et al. | 315/248 |
| 2010/0242298 | A1 * | 9/2010 | Tweedy et al. | 34/275 |

* cited by examiner

*Primary Examiner* — Nikita Wells
*Assistant Examiner* — Johnnie L Smith
(74) *Attorney, Agent, or Firm* — MacCord Mason PLLC

(57) ABSTRACT

Apparatus for curing a photocurable material applied to a floor surface includes a carriage having wheels, a source of curing light carried by the carriage, and a solid state ballast circuit selectively energizing said light source. The apparatus is free of a shutter that would selectively cover the source of curing light.

20 Claims, 16 Drawing Sheets

SHUTTERLESS, INSTANT RADIATION DEVICE FOR CURING LIGHT CURABLE FLOOR COATINGS

BACKGROUND OF THE INVENTION

This application is entitled to the benefit of the filing date of U.S. Provisional Patent Application Ser. No. 61/038,940, filed Mar. 24, 2008.

The present invention relates to a floor care machine, and more particularly, to a mobile, powered machine for curing a floor coating using ultraviolet ("UV") light. The machine of the illustrated embodiment contemplates that a liquid floor coating be applied manually, but the invention relates, as well, to apparatus which both applies the liquid floor coating and cures it in situ. As used herein, the terms "floor coating" or "coating" or "curable floor coating" and equivalents are intended to be broadly interpreted and refer to floor coatings applied in the liquid state and capable of curing to a solid state upon being irradiated by light. The light in the illustrated embodiment which effects curing is primarily in the ultraviolet region, but may include light in the near visible. However, the instant invention is not dependent on any particular coating materials. The invention relates to all materials which cure upon application of radiant energy (i.e. "photocurable" materials), whether it is in the ultraviolet region primarily, or includes both ultraviolet, near visible and visible light, as persons skilled in the art of photocurable materials will understand.

Virtually every gaseous light source today used to produce this type of radiation requires a warm up time of from a few minutes to up to fifteen minutes to reach full brilliance. Additionally, when the light source is turned off (intentionally or not) it can take up to 30 minutes for the light source to reignite, plus again the warm up-time. Therefore, a mechanical shutter needs to be placed in front of or around the light source to block the radiation from escaping when light is not desired and during warm-up and stand-by. After the light source has reached full brilliance, the shutter is opened and the device becomes useable. If the light source is turned off, it can not be re-lit until the light source cools sufficiently; hence the use of mechanical shutters.

Virtually all floor curing devices use shutters, which add size, weight, and cost to the machine. Those floor curing devices that do not use shutters suffer the effects of very slow warm up times and low energy output.

SUMMARY OF THE INVENTION

The present invention fulfills one or more of these needs in the art by providing an apparatus for curing a photocurable material applied to a floor surface, including a carriage having wheels; a source of curing light carried by the carriage; a solid state ballast circuit selectively energizing said light source; and the apparatus being free of a shutter that would selectively cover the source of curing light.

Preferably, the carriage has a peripheral shroud around the light source extending downward from the carriage toward the floor surface to be cured to mask light from escaping sideways from the apparatus.

The carriage may have a motor to drive the wheels and a selectively actuable clutch to enable the wheels to be "free wheeling" when the clutch is not engaged. An air knife between the source of curing light and the wheels can be included to cool the cured surface before contact by the wheels. Preferably, the carriage has front wheels and the source of curing light is on a front of the carriage, and the air knife is between the source of curing light and the front wheels.

In a preferred embodiment the carriage has primary wheels that support the carriage and contact a floor that is being cured. A supplemental set of wheels is also included that are not in contact with a floor while it is being cured. The supplemental set of wheels is positioned on the carriage so that they can be engaged with the floor by tilting the carriage and thereby lifting the carriage and the primary wheels off the floor.

Typically, the solid state ballast circuit is capable of outputting a current to cause instant strike of the light source at room temperature. More preferably, the solid state ballast circuit is capable of outputting a current to cause instant strike of the light source at the light source's operating temperature.

Desirably, the carriage has a tilt switch that turns off the light source if the carriage is tilted.

The source of curing light preferably includes a light fixture and a lamp. One embodiment of the lamp has an elongated normal section, two 90 degree bends and ceramic fittings at the ends of the bends. The ceramic fittings include a tapered leading end and an annular groove, such that insertion of the tapered end into a housing with a spring clip will open the spring clip and continued insertion will allow the spring clip to close and engage the annular groove.

In another embodiment the lamp is substantially linear and the same ceramic fittings allow quick attachment. The lamp itself is linear, but is mounted in a 'pseudo-90 degree' ceramic end fitting. Lead wires have ceramic beads to allow for the lamp to 'float', yet remain flexible, and protect against shock damage during use and transport. The top portion of the lamp, which physically attaches it to the machine, uses the same ceramic end pieces as the 90-degree lamp of the first embodiment.

The invention can also be considered as a method of curing a photocurable material applied to a floor surface, including moving a carriage having wheels over the floor surface; exposing the floor surface to curing light emanating from a light source carried by the carriage at an operating temperature of at least 600 degrees Celsius; turning off the light source to stop curing the photocurable material; turning the light source back on while the light source is still hot; and resuming movement of the carriage over the floor surface to resume curing.

Moving may include moving an air knife over the floor surface to cool the floor after curing before the floor is contacted by a wheel of the carriage.

The method may include adjusting a handle length on a handle of the carriage.

It may also include supplying electricity to a ballast for the light source and determining a supplied voltage to selectively apply the voltage to a tap on the ballast according to a determined voltage supply.

In a preferred embodiment the method includes determining a suitable speed for the carriage to achieve optimum curing in dependence on a sensed output of the curing light emanating from the light source and providing an output signal to correct for excess speed or insufficient speed.

Preferably, the method also includes applying cooling air to the light source after turning off the light source until the light source has cooled to a safe temperature.

The method may also include sensing non-movement of the carriage and turning off the light source when the carriage has not moved for a period of time.

For a driven carriage, the carriage may be moved by controlled signaling of a motor driving at least one wheel of the carriage. The movement may be effected with wireless communication control. The motor can be any suitable type, including without limitation, an AC motor or a DC motor.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

The present invention offers a shutterless, portable, mobile floor curing device for applying light radiation to a coating which has been applied to a floor surface. The floor surface can be concrete, wood, vinyl or any other material which is conducive to this process.

Figure 1:
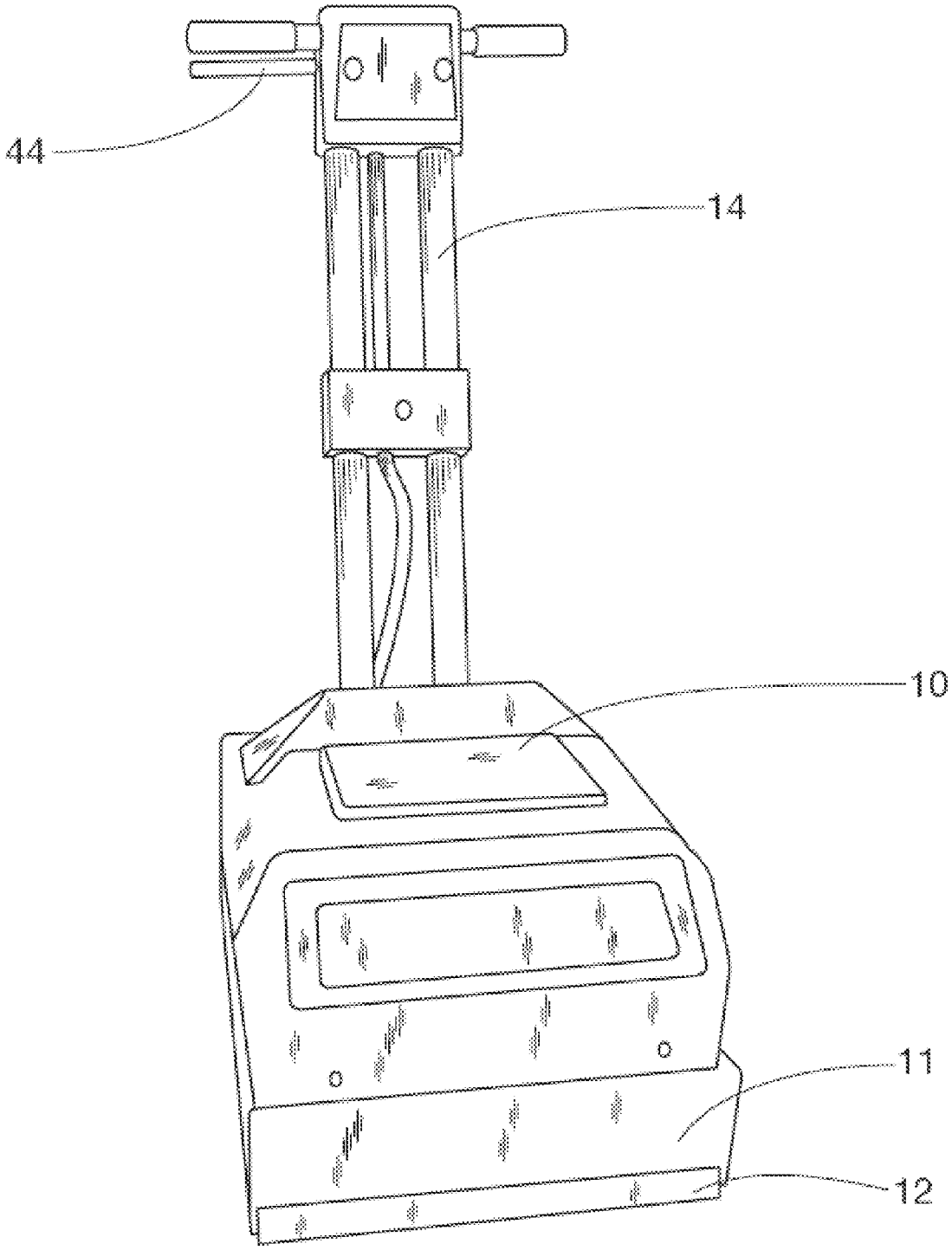
FIG. 1 is a front perspective view of an apparatus in accordance with an embodiment of the invention.

FIG. 1 shows an apparatus in accordance with an embodiment of the invention. Visible in FIG. 1 is a housing cover 10, having a depending skirt 12 to shroud the light source to prevent dangerous UV emissions from harming a user's eyesight and other untoward effects of stray UV, and a handle arrangement 14. The skirt 12 is a replaceable flexible peripheral light shield mounted to the irradiator in close proximity to the floor. The light shield may be made from extruded silicone rubber, but could be made from any suitable flexible or quasi-flexible material that will not degrade with heat and UV radiation. The skirt thus acts as a peripheral shroud around the light source extending downward from the carriage toward the floor surface to be cured to prevent light from escaping from the apparatus.

As used herein, radiation refers to the energy which causes curing, cross-linking, catalysis or any other system that changes from a liquid to a solid via light radiation. The light that is used is preferably within the frequency range of from 200 nm to 500 nm in the electromagnetic spectrum. A principle emission at 365 nm is preferred.

Figure 2:
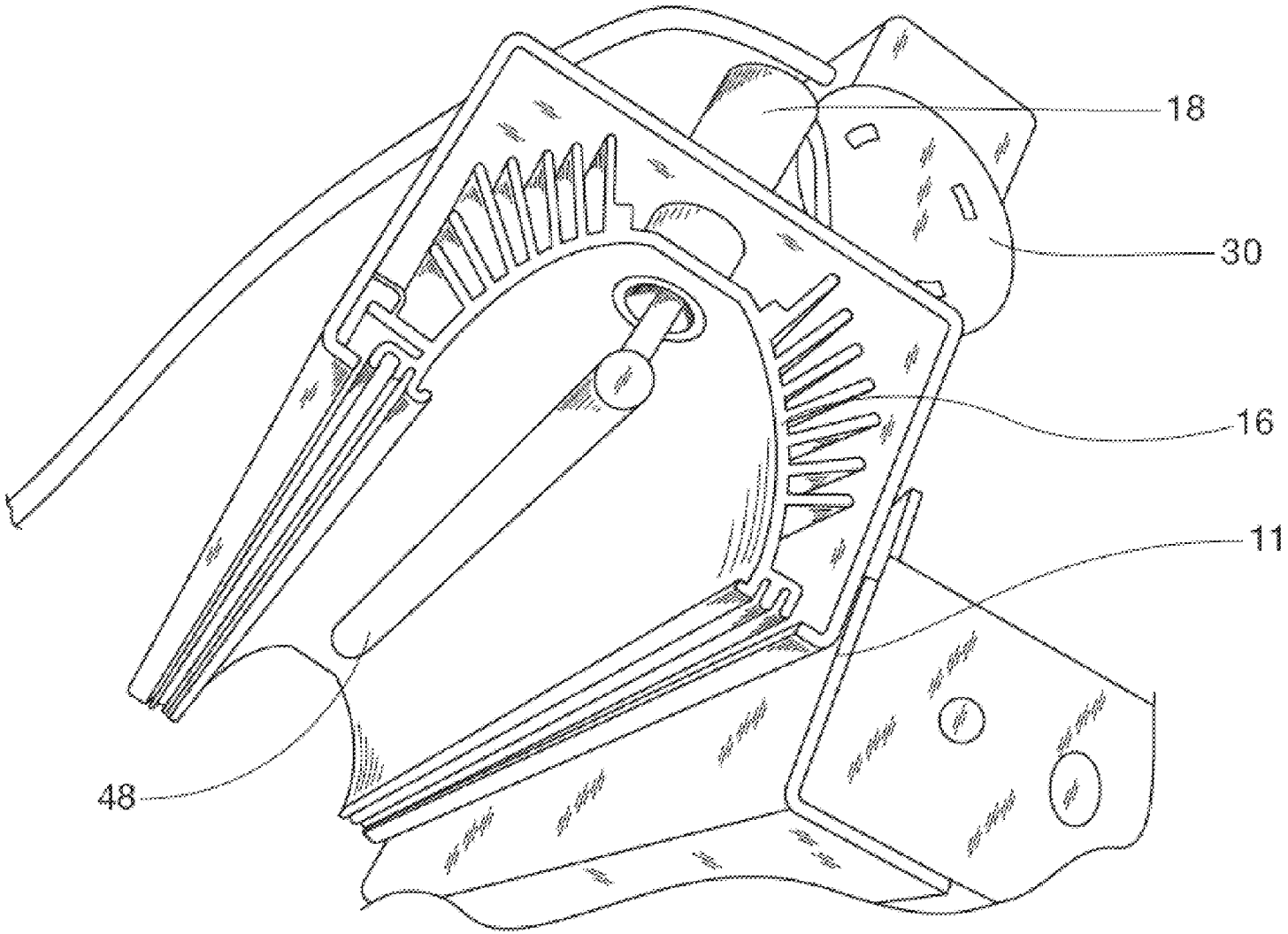
FIG. 2 is a lower perspective view of a front of the embodiment of FIG. 1, with portions removed.

FIG. 2 is a lower front perspective view of the apparatus of FIG. 1, with the housing cover 10 and other electronic components removed. The apparatus in accordance with the invention is shutterless, enabling it to use an extremely small and efficient irradiator housing 16 and be lighter in weight. This enables the light source to reach places otherwise impossible, such as corners, overhangs, etc. Further, the invention offers instant light energy whether the light source is hot or cold, making the device efficient. Shutterless irradiators are less costly and are much more reliable since they lack any mechanical, electrical or pneumatic shutter mechanisms. FIG. 2 shows the light source mounting housing 18, to be discussed in further detail below.

In some embodiments, an air-knife is located behind the irradiator but in front of any of the wheels. This air-knife includes a blower that generates an air flow, which quickly reduces the temperature of the sensitive, newly-cured surface. The temperature of the newly-cured surface may be elevated, due to an exothermic action of the coating and/or the heat generated from the light source.

Figure 9:
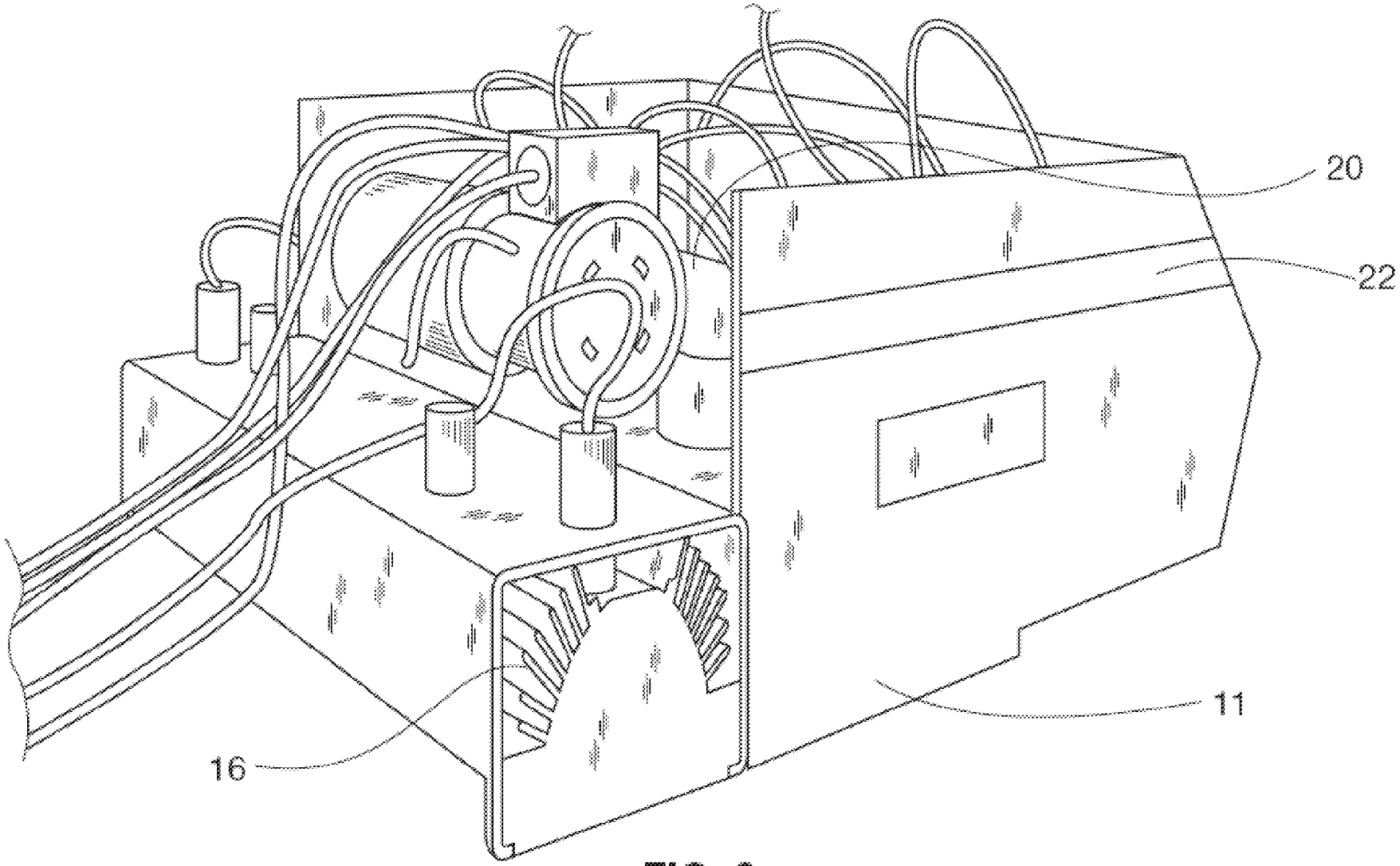
FIG. 9 is a side perspective view of a front of the embodiment of FIG. 1, with portions replaced showing circuit elements, but with the cover removed.

The electronic ballast for the light source is an instant start, hot re-strike/accelerated warm-up ballast 20 seen in FIG. 9. The ballast is the commercially available ISHRA Ballast manufactured by HID Systems, Inc. of Sparta, N.J. which enables the elimination of a mechanical shutter. The ballast may be as described in U.S. Pat. No. 4,455,510 to Lesko entitled High Intensity Discharge Ballast with Hot Restrike Performance, the entire disclosure of which is hereby incorporated by reference. The ballast may be mounted to a frame or incorporated into the frame 22. As seen in FIG. 9 the frame 22 is mounted on the carriage 11.

The device includes a wheeled frame or chassis, making a carriage 11. The front wheels 26 (see FIG. 5) can be fixed drive wheels (or idler wheels, in the case of a manually propelled machine). The rear wheels 28 can be swivel or steerable. Alternatively, the swiveling wheels may be in front and regular wheels in rear. There can be a single, double or triple set of rear wheels. Further, there can be single or double swivels, all as required to appropriately distribute the weight load of the device over the relatively sensitive surface of the newly cured floor. These wheels are all placed on the carriage 11 so as to be closer together than the width of the area cured by the projected light. The wheels may be system steer-able in the case of an automated model. A handle 14, which may be pivotal as at 42 (See FIGS. 6 and 7), is attached to the frame and may hold some or all of the operator controls 44. Such controls can include an on/off switch for the light and on/off and speed controls for the propelling motor, if there is one.

Figure 6:
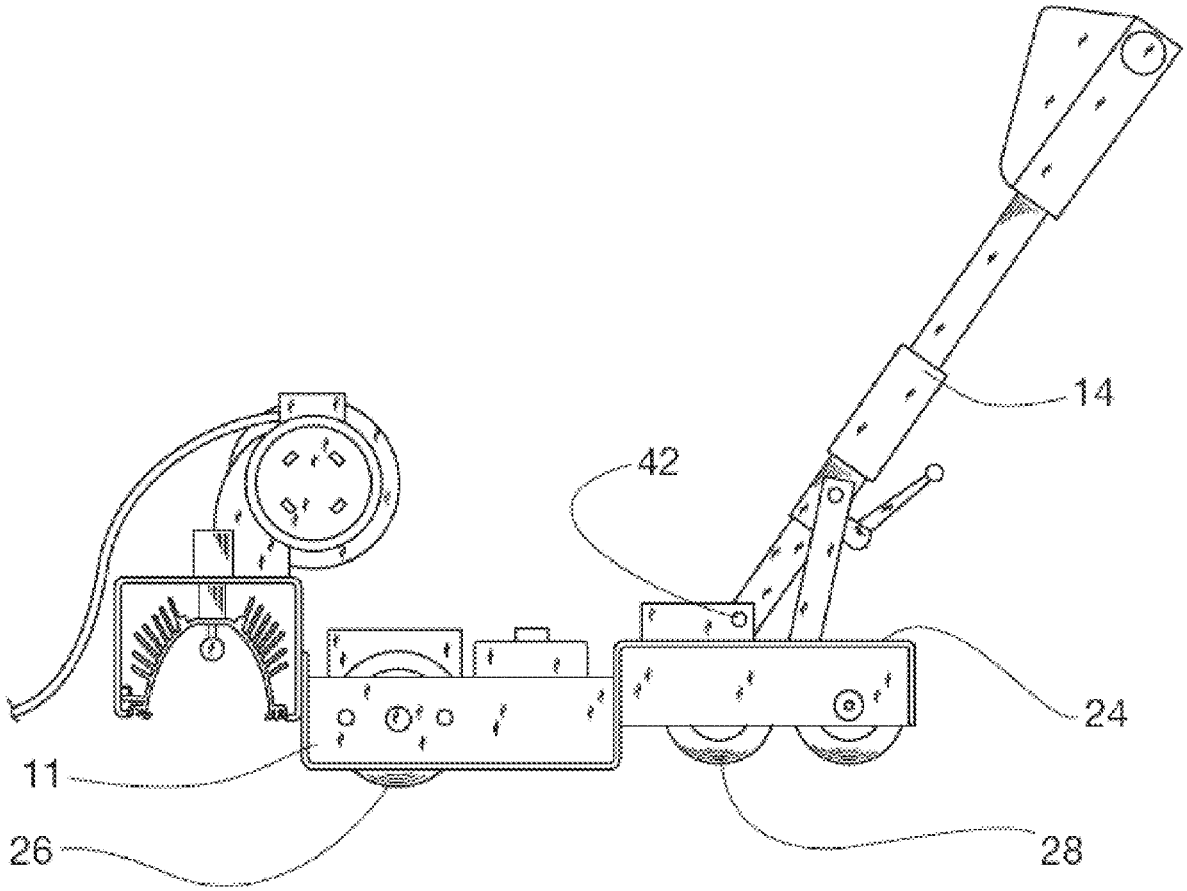
FIG. 6 is an upper perspective view of a side of the embodiment of FIG. 1, with portions removed and showing the handle collapsed.

Turning now to FIG. 6, the carriage is seen having wheels 26 and 28. Usually, a minimum of two, but typically three, four or more wheels are used to move the device across the floor to be cured. The wheels may be free wheeling, fixed or swivel. The device can be pushed or pulled. The embodiment shown in the figures includes a drive motor 32 seen in FIG. 3. The wheels can be motorized for automatic propulsion, or not. The motor can be any suitable type, including without limitation, an AC motor or a DC motor.

A handle 14 is preferably attached to the frame to maneuver the device for curing and transport. The irradiator 16 is preferably suspended in front of the front wheels 26. The light source may be the same width or wider than the device, but the area irradiated is preferably wider than the outside width of the wheels, so that as the carriage moves over a floor, the UV light hits the floor and accomplishes curing before the wheels contact the uncured finish on the floor. The light source may be fixed or removable.

The device can be manually propelled and/or motor driven. It can be motorized, guided by an operator who walks with the machine guided by a remote control apparatus, either wired or wireless, allowing for steerability. It can be laser guided, or under control of a relative (indoor radio triangulation, etc) or absolute positioning system (GPS, etc).

The drive wheels can take the form of a roller, whether solid or segmented, to distribute the weight load of the device over the sensitive surface of the newly cured floor.

Figure 3:
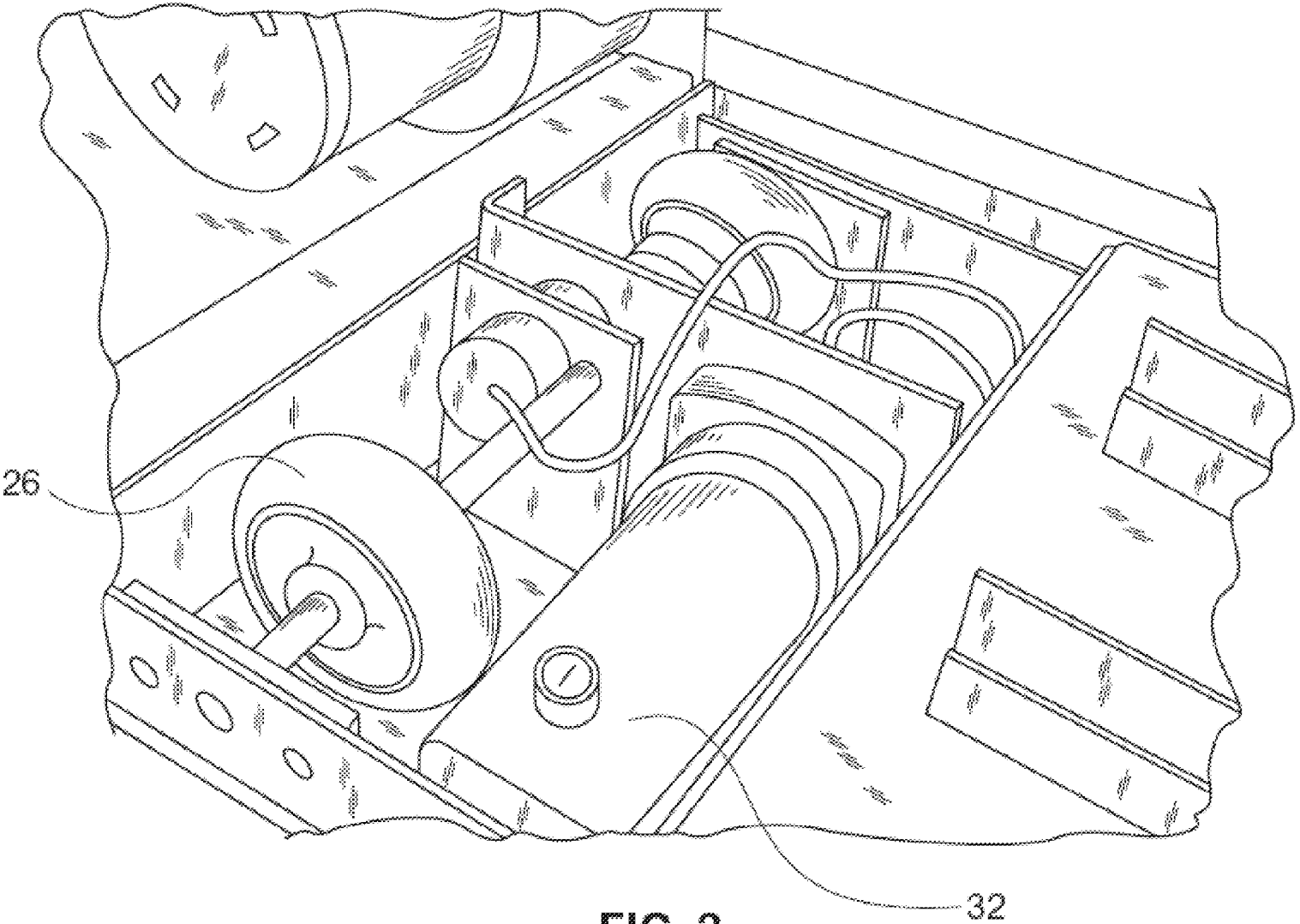
FIG. 3 is a top perspective view of a mid-portion of the embodiment of FIG. 1, with portions removed.

For a carriage with motor-driven wheels, the apparatus can include an electromechanical clutch seen in FIG. 3 which couples the drive motor to the output wheels. This clutch is engaged whenever the device is needed to move. This clutch preferably enables the device to be "free wheeling" when not engaged, allowing the device to be easily maneuvered manually and freely if desired, such as for transport or in corners or other tight spaces.

The apparatus can also incorporate "one way" mechanical clutches in the drive wheels of the motorized version. These clutches allow the device to make turns creating a "differential" effect. Without them, the left wheel would be dragged when making a right turn, and the right wheel would be dragged when making a left turn.

Figure 4:
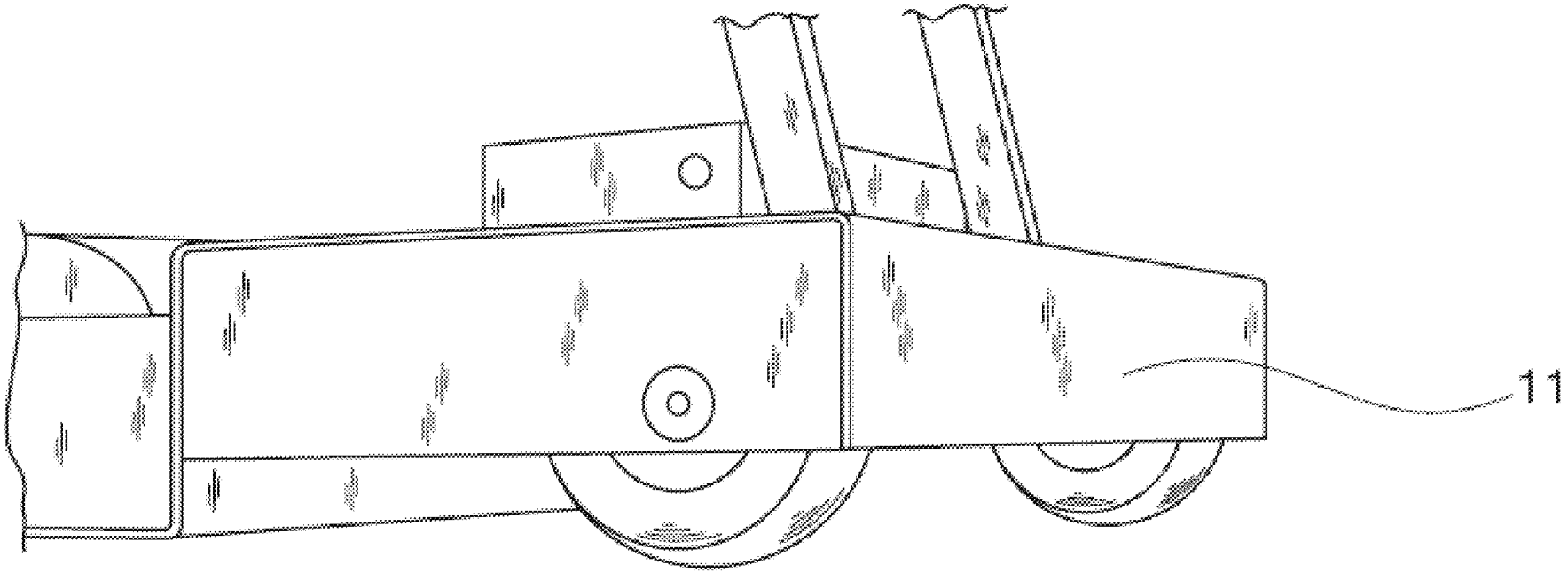
FIG. 4 is a side perspective view of a front of the embodiment of FIG. 1, with portions removed.
Figure 5:
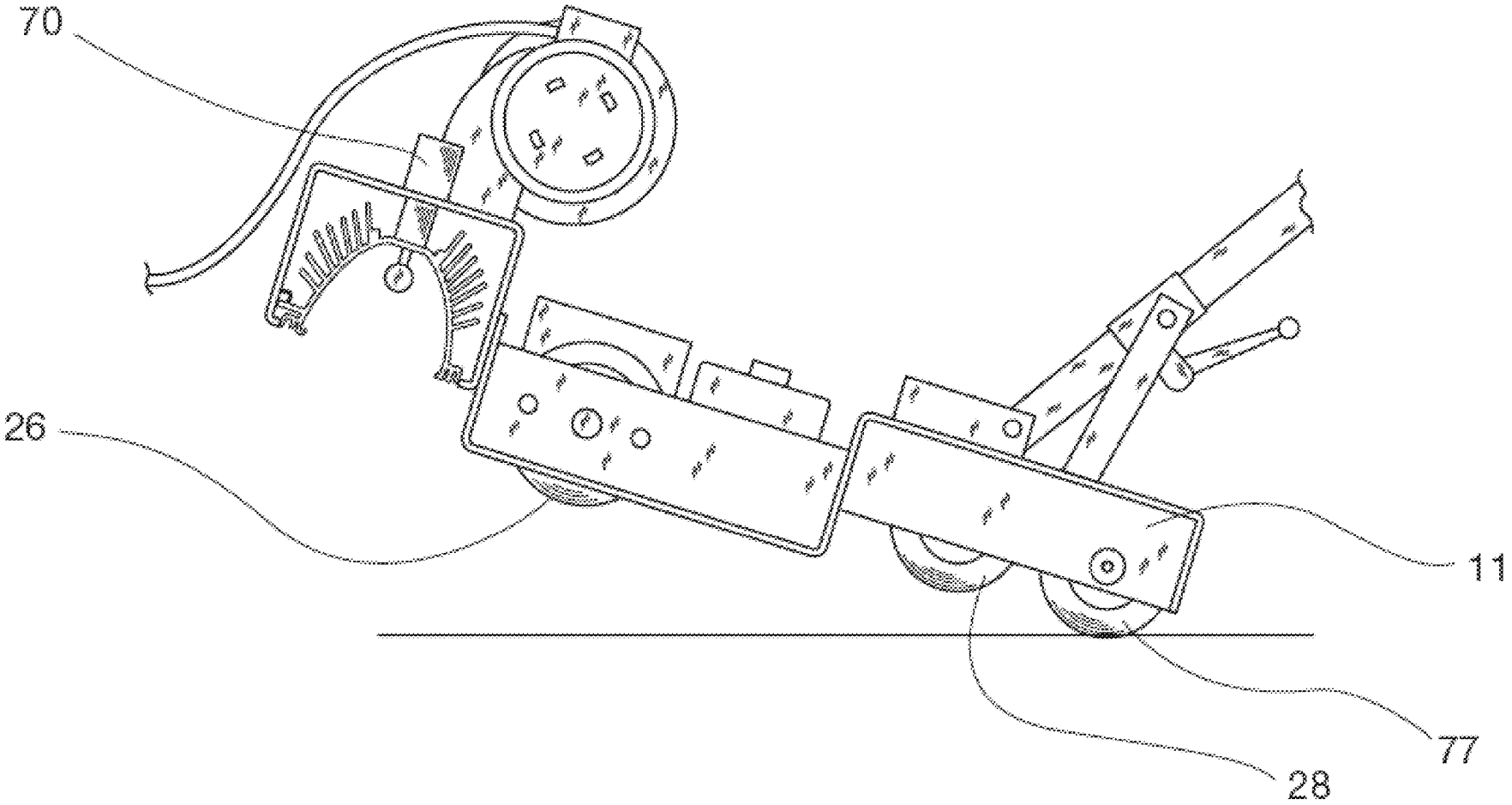
FIG. 5 is a side perspective view of the embodiment of FIG. 1, with portions removed and showing the Wheelie wheel in action.

As seen in FIGS. 4 and 5, an additional pair of wheels 77 can be included which, in normal use, do not touch the ground. These are particularly useful with a carriage having a handle extending up and to the rear. These additional wheels are mounted to the rear of the carriage. When the handle 14 is forced downward, the carriage pivots upward, initially wheels 28. Then, with further motion, the rear-most wheels 77 contact the ground. These "Wheelie-wheels" aid in the quick and easy transport of the device. They further allow transport on surfaces that are less than desirable, such as paved or concrete parking lots and driveways, protecting the device's primary mobility wheels 26 and 28. Protecting wheels 26 and 28 is useful because they are the ones that make contact with the sensitive surface of the newly cured floor surface and need to be kept clean so that they do not scratch or mar the surface when they traverse the newly cured floor.

Figure 7:
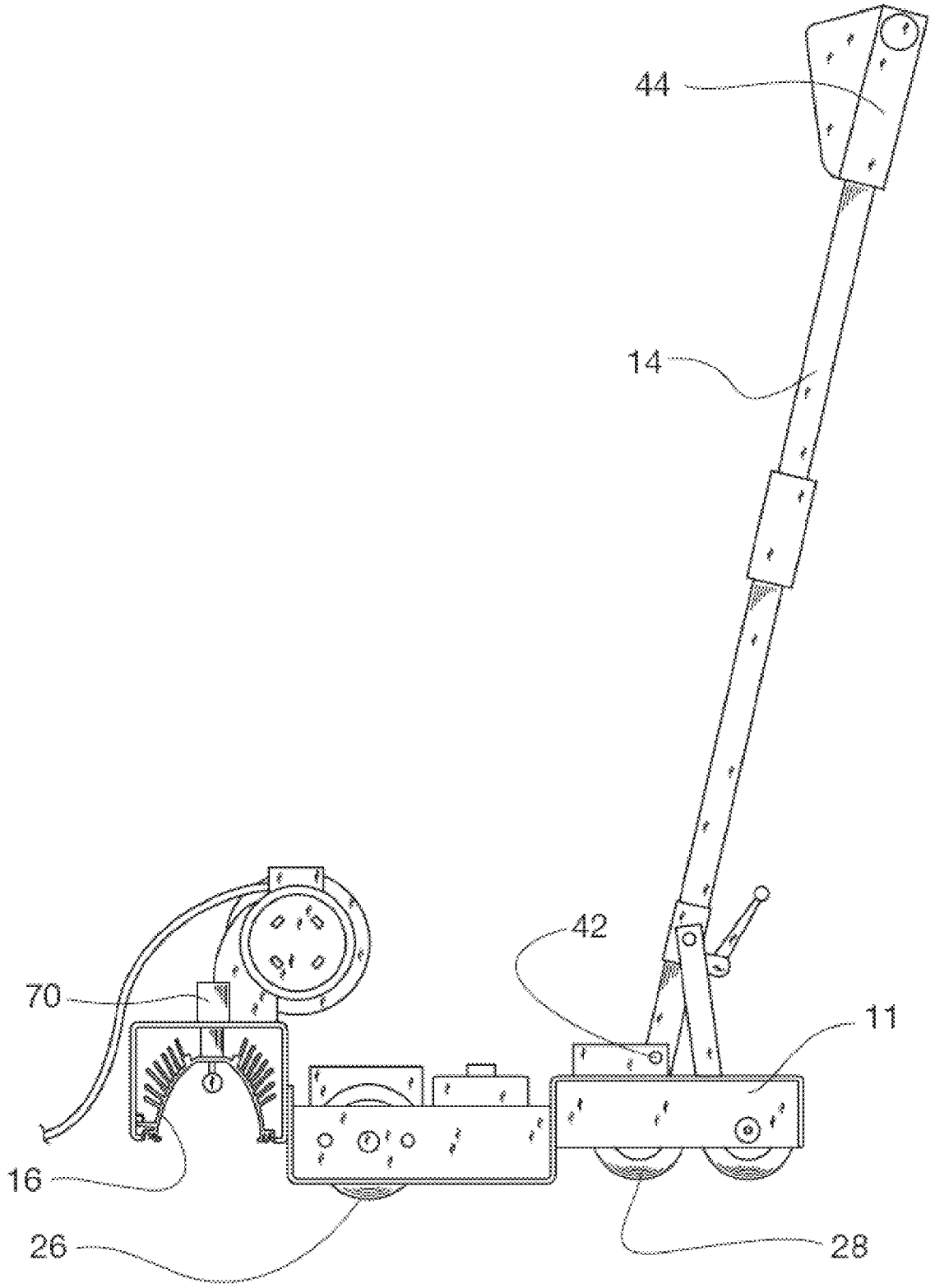
FIG. 7 is an upper perspective view of a side of the embodiment of FIG. 1, with portions removed and showing the handle extended.
Figure 8:
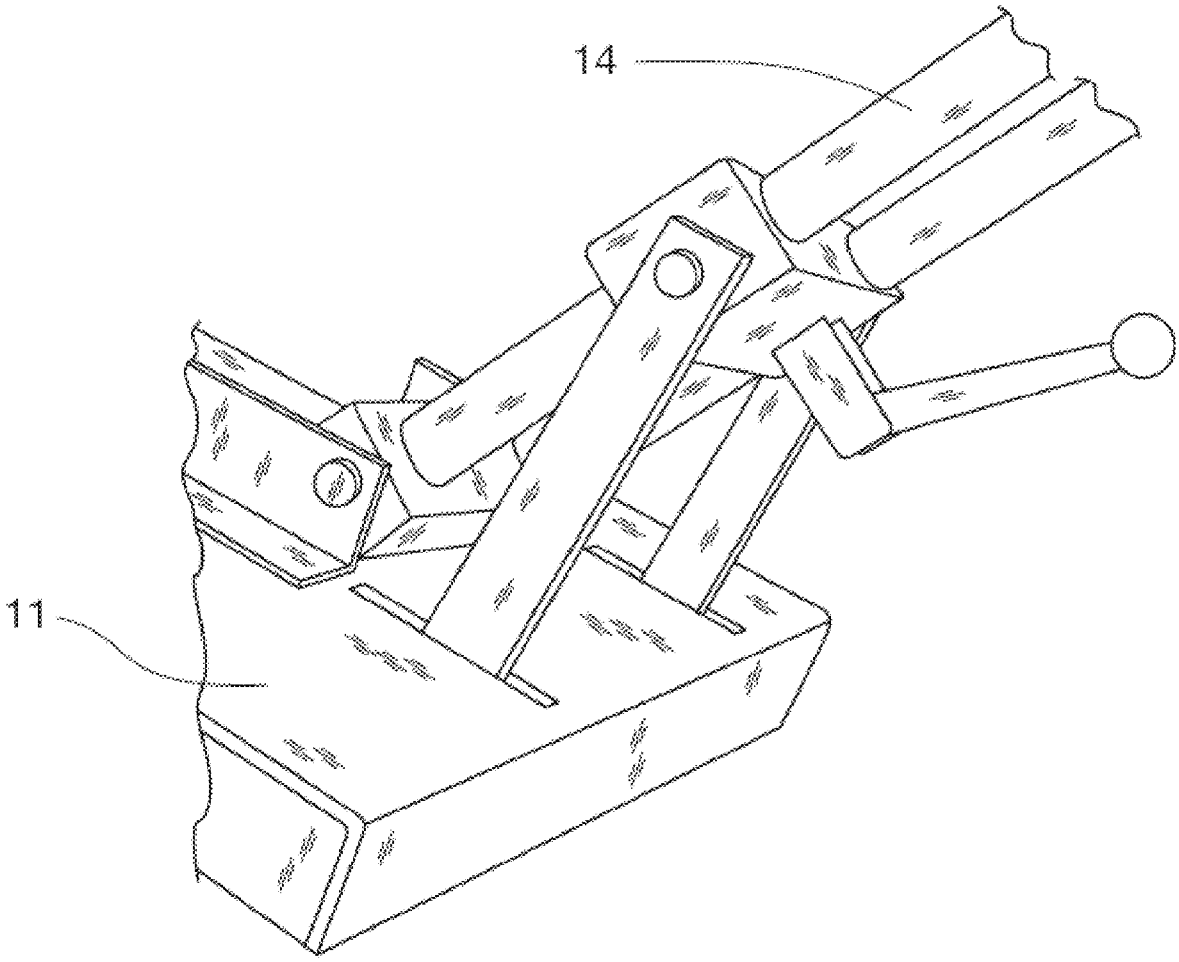
FIG. 8 is a left rear perspective view of a side of the embodiment of FIG. 1, with portions removed.

As seen in FIGS. 6 and 7 the handle 14 may be adjustable in angle and length so as to be collapsible, making the device more user-friendly and giving the machine the ability to be transported and stored in smaller spaces.

Figure 10:
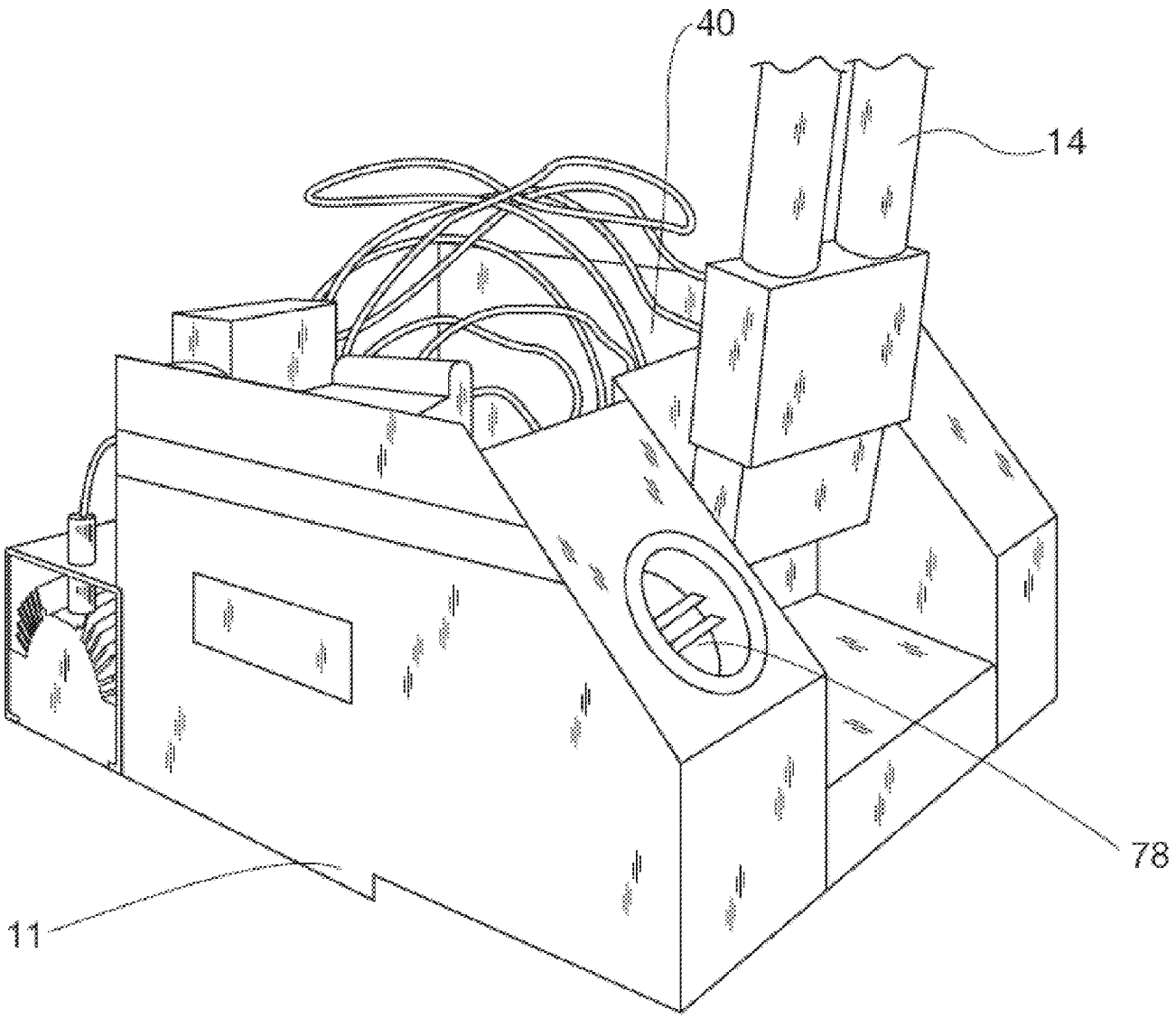
FIG. 10 is a left rear perspective view of a front of the embodiment of FIG. 1 in the same state as in FIG. 9.

A shutterless light irradiator (light housing) includes the light source 48 (see FIG. 2), which is attached to the frame in front of the front wheels, and a suitably matched ISHRA Ballast 20. A socket 78 seen in FIG. 10 allows an external electrical supply to be connected. Depending on the light energy required, the units may be 120v for up to approximately 1800 w to the lamp. These units are usually the smaller machines for smaller spaces or where available power is limited. Much higher power units require multiple 120v services or higher ampere capacity 208-240v service. Further, the device may contain its own electrical power generating source.

Figure 11:
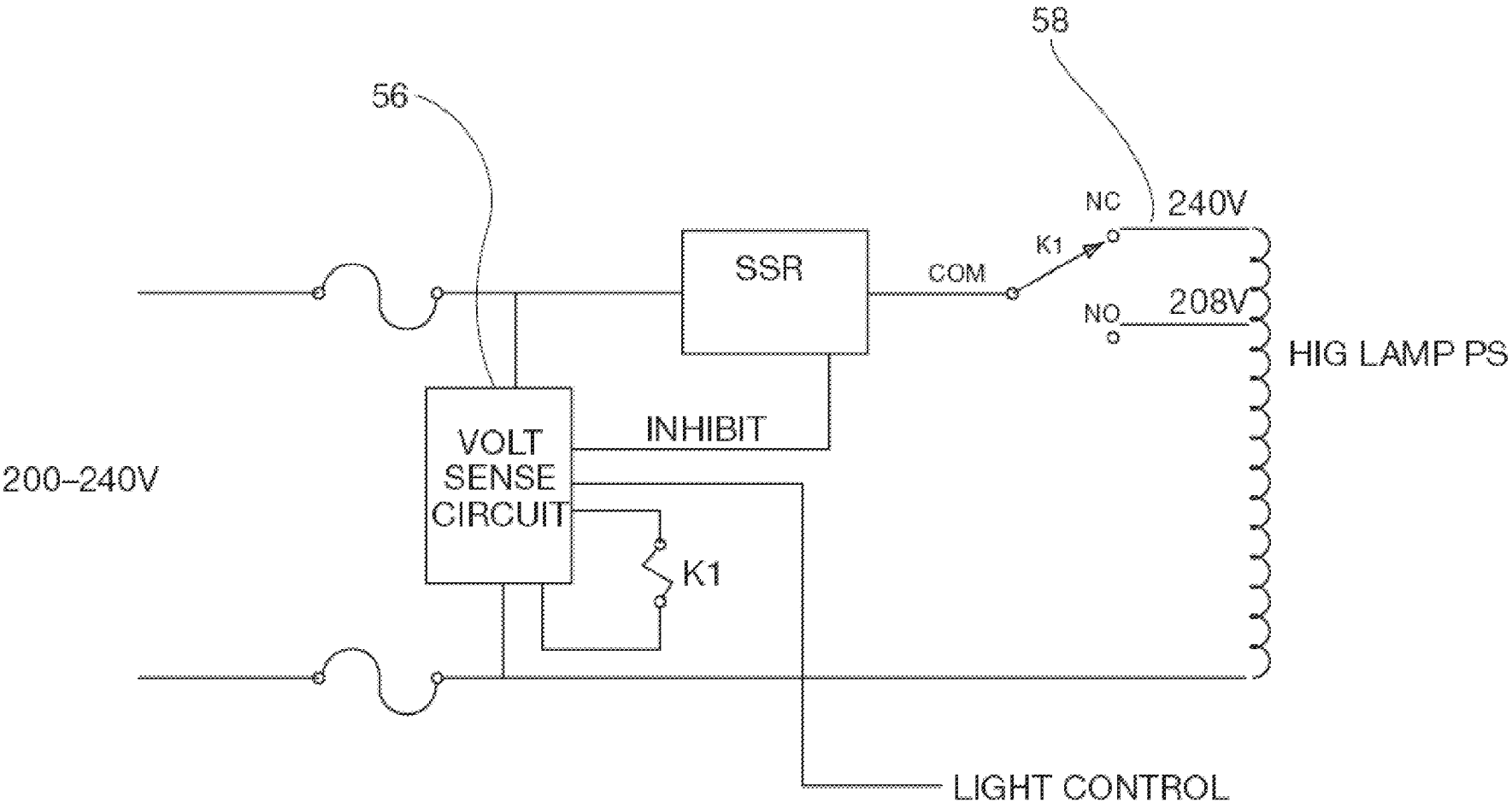
FIG. 11 is a circuit diagram of the selective voltage tap-sensor feature.

The apparatus can include an auto voltage tap selection adjustment feature. The device can be operated on a variety of power systems. Most think of available electrical power as 120 volt or as a "220 volt system." However in reality, the power available in a "220 volt system" can be anywhere from a nominal 208v to 240v, depending on the distribution method. In addition, there are tolerances within each method. As seen in FIG. 11, an embodiment of this invention measures the line voltage at 56 and selects an appropriate input tap setting 58 so that the ISHRA Ballast operates at, or within the safest and most efficient parameters. Applying an overvoltage can seriously damage system components and dramatically reduce light source life. Applying an under-voltage can cause insufficient curing and serious spectral shifts of the light source. The auto tapping circuit may include as many different taps are as needed to accommodate the electrical environment the machine is intended to be operated in.

The apparatus may include tip and/or tilt sensors (not shown) to turn off the light in the event the device is tipped or tilted, to prevent the escape of UV radiation, when the carriage is tilted. The UV radiation is normally directed downwardly and contained by the shroud or skirt 12, but in the event of a tilt, UV would be less contained. The tip/tilt detection mechanism can be a multiaxis accelerometer, or series of single axis accelerometers. By calculating the acceleration due to gravity on any axis, or by using trigonometric calculations on multiple axes to increase accuracy, the angle of the machine can be determined.

The apparatus may include a Speed Integration control (not shown). The UV light source emits dynamic light energy, but the exact amount and character of the light energy actually produced is subject to many factors. The energy changes with lamp temperature, age, voltage, spectral shift, etc. Speed Integration control includes as sensor to measure the dynamic energy emitted by the light source and appropriate circuitry (digital or analog) to correlate the sensed energy output with the speed of the carriage to determine if the carriage is moving too fast (i.e. the surface being cured is not having enough exposure time), or too slow to achieve optimum curing. For an automatically driven carriage, the controls affects the drive speed of the device by outputting signals to the drive motor to speed up or slow down, as needed. The apparatus can include a drive motor with a stepper motor drive. This facilitates the use of direct digital data rather than using digital to analog conversion to drive traditional motors. Suitable control electronics 40 can be included to generate the step pulses. In the case of a manually propelled machine, a visual and or audible signal tells the operator to react to the signal by moving the machine faster or slower.

The delivered UV light intensity may be measured by an appropriate sensor (not shown), using an optimized optical filter. In a preferred embodiment the signal is amplified and converted to a digital form. After being processed by a linearization algorithm, the intensity value is input to a "mixer" for correlation with the actual speed and product selection. The actual speed is obtained from an appropriate carriage speed sensor.

The speed sensor can take the form of a single encoder or multiple encoders (not shown) to measure the movement of the device. A sensor, photo optical, electro mechanical, capacitive coupled, inductive, etc, senses the movement/non-movement of a wheel or wheels of the device. In another embodiment, a contact device to the floor actually determines whether the device is moving, additionally yet in another embodiment a non-contact sensor determines whether the device is moving over the floor, still yet in another embodiment, movement is determined by GPS or other full logic control.

The apparatus can include a light source post cool-down time or temperature control circuitry. Under normal operation the light source operates at elevated temperatures, typically between 600 and 900 degrees Celsius. In order to safely transport or service the device, the light source temperature should be reduced. This is accomplished with the use of a timing device and/or a temperature sensing device which through appropriate circuitry commands the lamp cooling system to continue to cool the light source, even after the light source has been turned off, until the light source and/or housing temperature is safe.

The apparatus can include a "Non Movement" and light source control to eliminate the possible overheating and potential scorching of the floor or other surface. A sensor, which can be photo-optical, electro-mechanical, capacitive coupled, etc, senses the movement/non-movement of a wheel or wheels of the carriage.

The apparatus can incorporate wireless communication with other units, and/or a computer or other mobile device. With this, the device(s) synchronize positioning, unit status data, and allow for operator communication. The apparatus can incorporate wireless communication with any test or diagnostic equipment.

Figure 13:
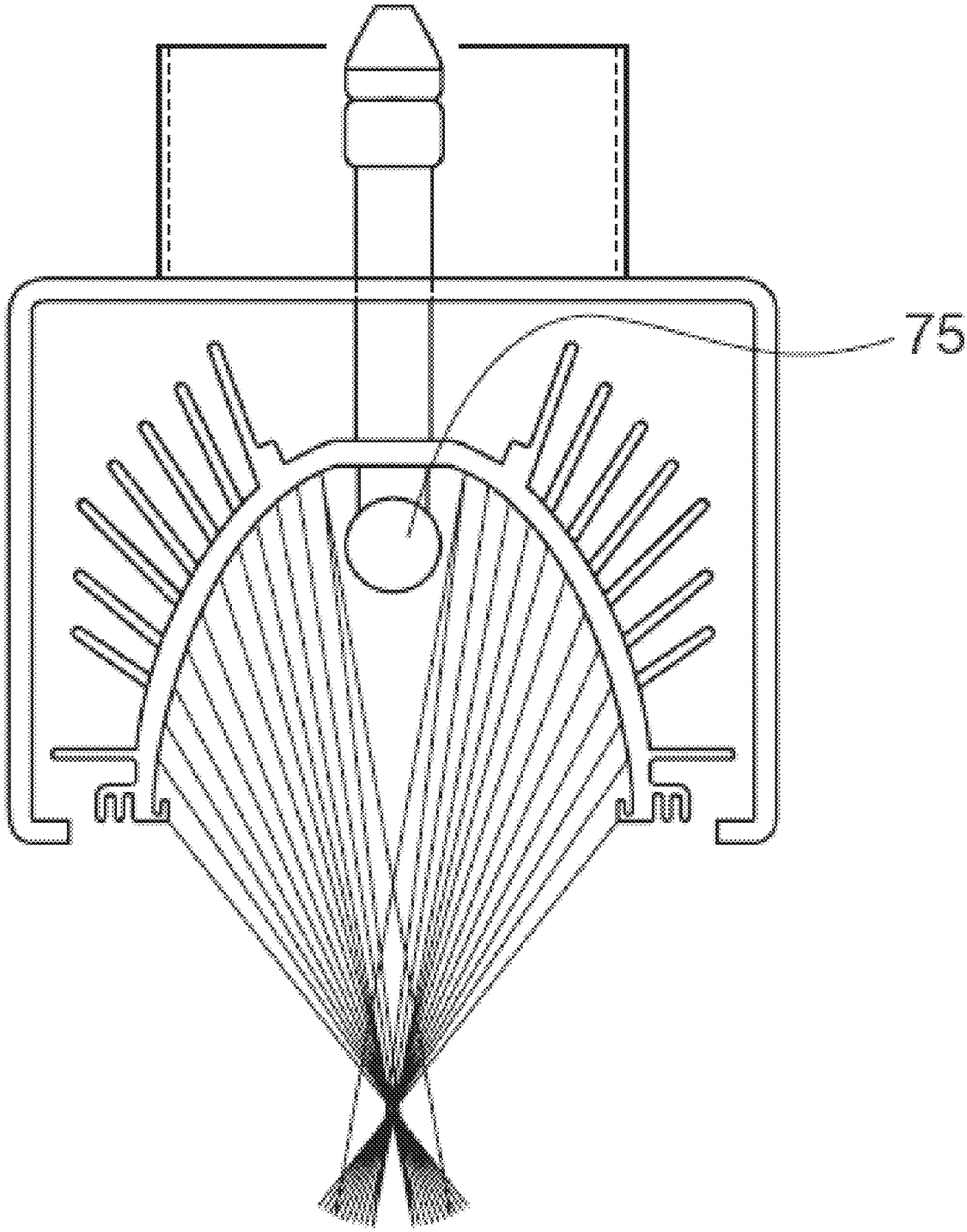
FIG. 13 is a side elevation view of the lamp in place in a reflector and showing the ray traces emanating from the properly positioned lamp, reflecting from the reflector.

The light source 48 preferably is mounted in the apparatus including a focusing reflector 16 using a novel mounting method capable of quick light source change and providing registration of the lamp correctly to achieve accurate focus. As seen in FIG. 13, the focus is selected to concentrate the UV emitted by the lamp on the floor to achieve the goal of curing the coating.

Figure 14:
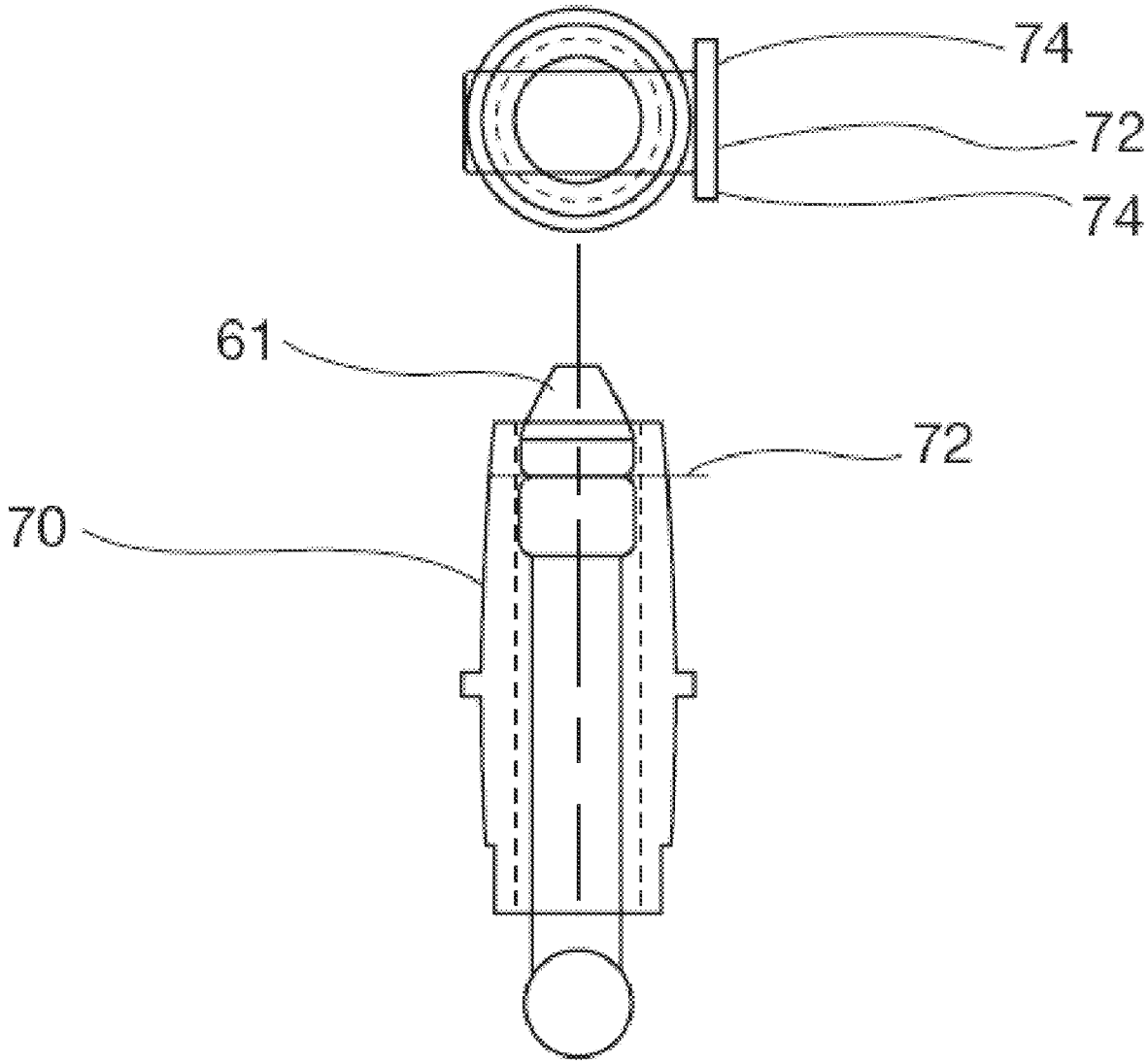
FIG. 14 is sectional view showing the lamp end inserted into a mounting housing and held on place by a spring clip.
Figure 15:
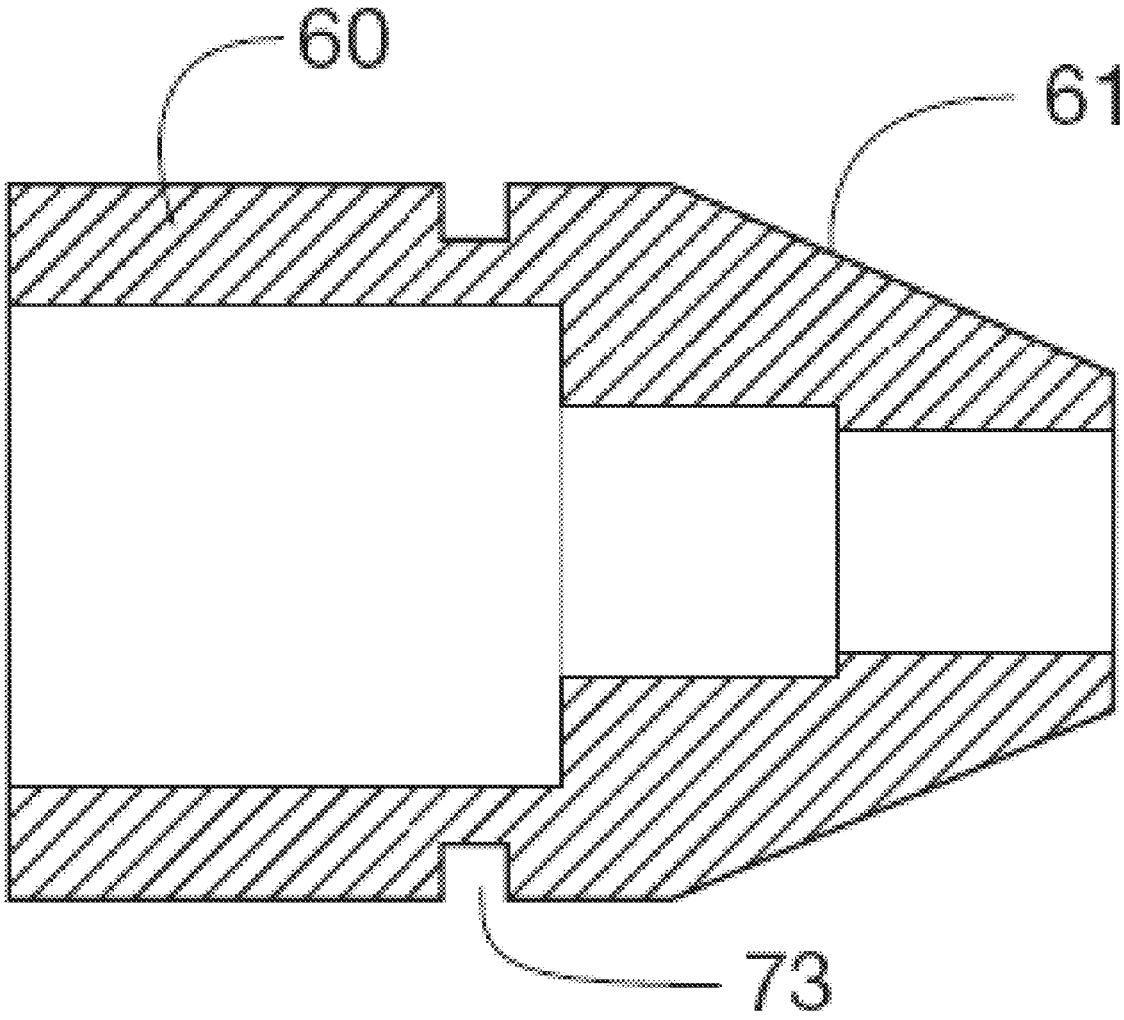
FIG. 15 is a sectional view of one of the end mounts of the lamp.

As seen in FIGS. 12-15 a lamp 48 with two 90° bends has special shaped end mounts 60 that mate in a housing 70 seen in FIG. 14 that is secured to the reflector 16. The shaped end mounts 60 of the lamp and the housings 70 are made from high temperature ceramic, but could be made from other suitable materials. Spring clips 72 extending through the housing 70 are made from high temperature stainless spring steel, but could be made from other suitable materials.

Figure 12:
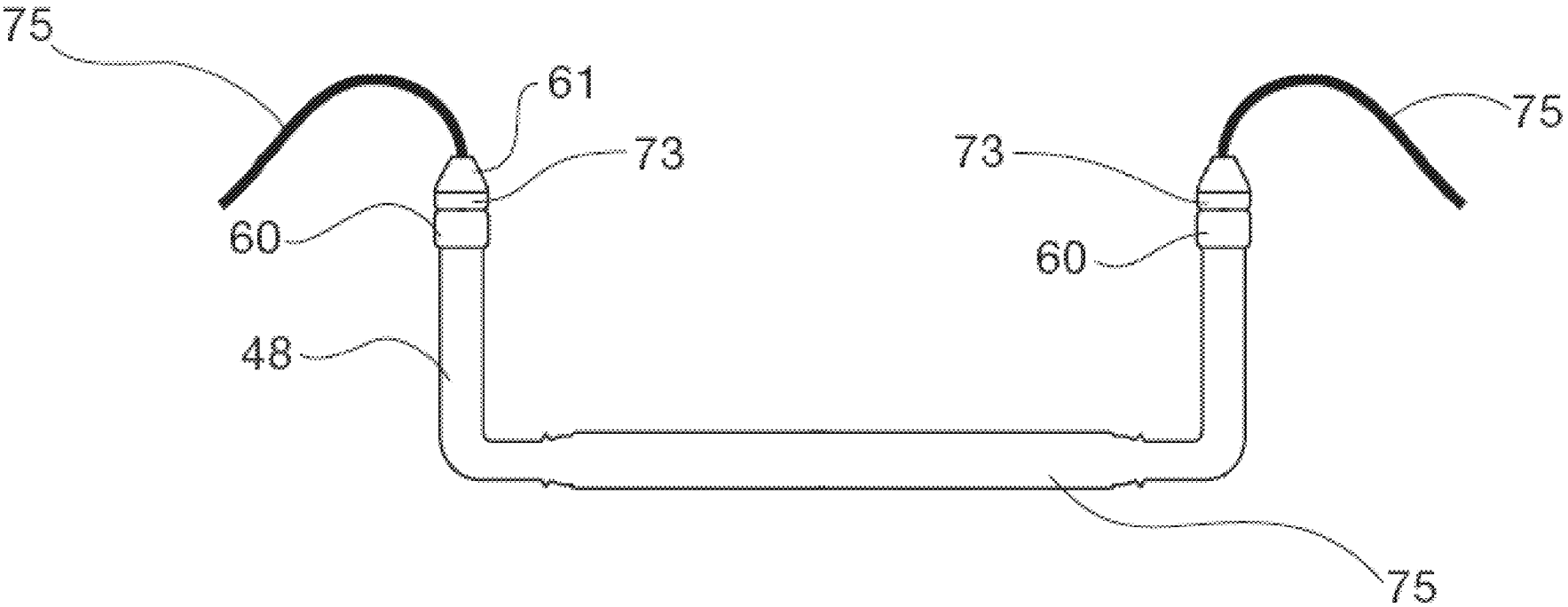
FIG. 12 is a plan view of preferred lamp in accordance with the invention.

Each of the two ceramic housings 70 is mounted to the reflector 16 or its outer shell by any suitable method. The lamp 48, which has the shaped end mounts 60 permanently affixed, is inserted through the front opening of the reflector 16. When the tapered end of the ceramic end mount 60 meets the spring clip 72, it forces the clip 72 open, and further movement of the lamp in the same direction of insertion allows the clip 72 to drop into the mating groove 73 in the ceramic end, thus holding the lamp 48 in the appropriate position. FIG. 12 shows electrical leads 75 that connect electrically to the ballast, not shown. The appropriate lamp position locates the main length 75 of the lamp correctly to be focused by the reflector, as seen in FIG. 13. The preferred lamp is the HID 11027-1 available from HID Ultraviolet, LLC, of Sparta, N.J. The lamp can be a CW or pulsed Xenon lamp. Other UV sources may be used, including other HID sources, including but not limited to gallium, gallium indium, and CW Argon.

Removal of the lamp is accomplished by squeezing the clip ends 74. This squeezing opens the clip, and the lamp can be pulled away to remove it. The clip is retained in the housing, which prevents loss.

Figure 12A:
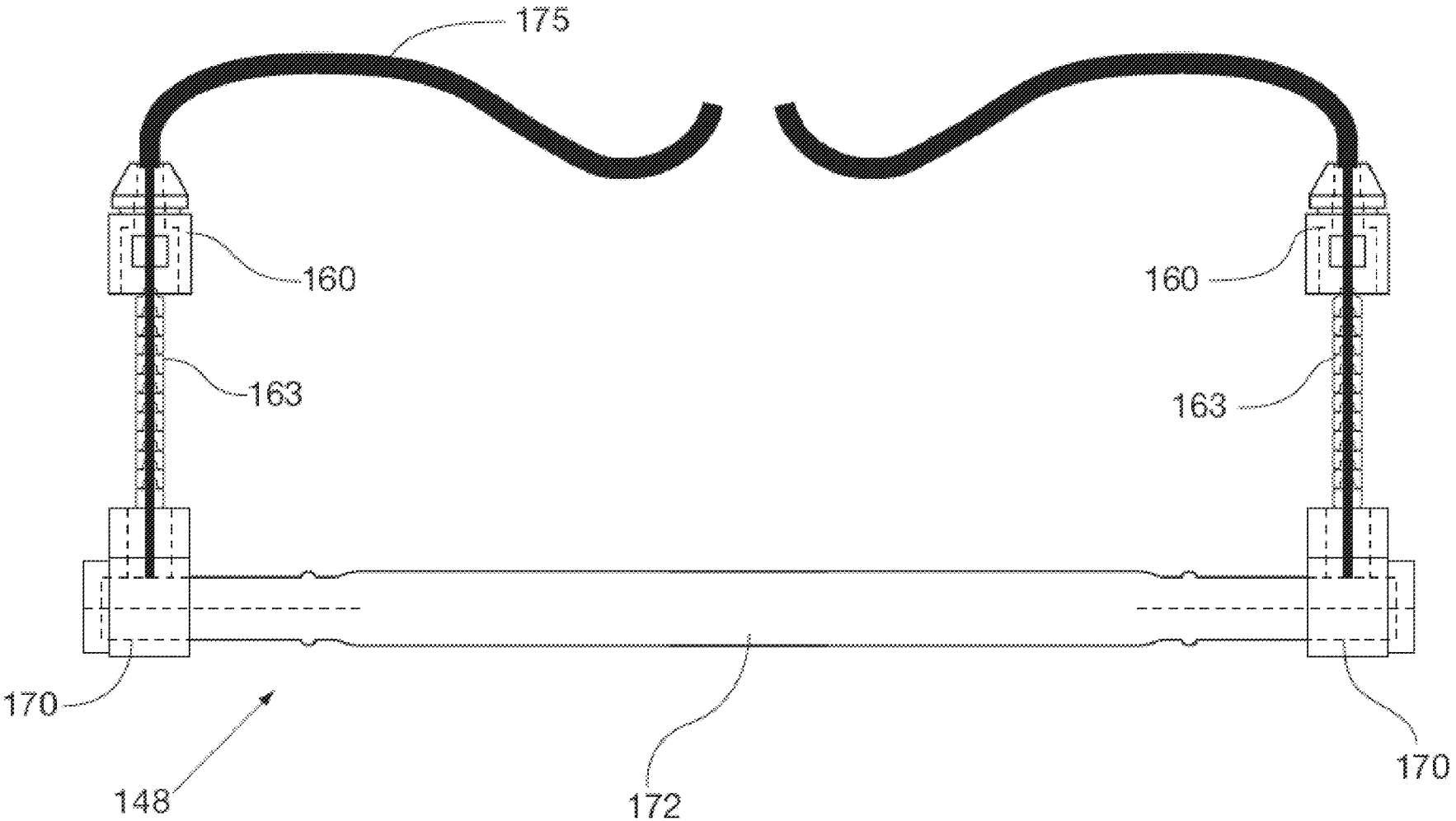
FIG. 12A is a plan view of an alternate lamp embodiment.

FIG. 12A shows an alternate lamp 148 configuration in which a linear lamp tube has 90° attachments at its ends to result in an overall configuration like that of lamp 48. The end mounts 160 are the same as mounts 60 used for lamp 48. Threaded through mounts 160 and a series of ceramic beads 163 are the lead wires 175. Wires 175 terminate at the lamp 147 in 90° ceramic fittings 170 that terminate the quartz tube 172. In one embodiment tube 172 is closed with Xenon low mercury. It may operate at 250-265 volts RMS; with a nominal lamp power of 6 Kw-9 Kw; a nominal lamp current of 24-36 amps and a maximum starting current of 50 amps. Installation and use of lamp 148 is as with lamp 48 discussed above.

Greater energy output rates are important commercially since the more wpi you have, the faster you can cure. Many of the formulators of floor coatings to be cured are specifying minimum powers needed, which can include two specifications:

1, Intensity, the peak brightness on the surface, typically measured in watts.

2, Energy, the integration of intensity and time which the surface sees, typically measured in Joules.

One manufacturer specifies a minimum of 400 mj/cm$^2$. In accordance with applicant's invention, the light output measured in watts per inch of the arc length of the lamp is at least 75 wpi and more preferably at least 100 wpi and can range as high as 270 wpi and on up to 500 wpi or higher. Regardless of the lamp power Applicant's embodiments force the lamp to come up to power quickly (accelerated warm up) using a lag ballast with enhanced circuitry.

In some embodiments applicant has constructed, the power output is as low as 1700 w. In such a machine a 15 inch cure path from a 12 inch arc length lamp, yields a watts per inch of 1700 w/12 inch=141 wpi, which is as much power can reasonably be provided by a 120v line. The unit is necessary for those who only have 120v available, such as homes and hospitals that do not have electrical power available above 120v. Greater power can be obtained from the same machine with the application of 208/240v.

In applicant's preferred embodiment the irradiator is a short focus irradiator, typically an ellipse of relatively small proportions so as to maximize the energy focus. The larger and the further away from the surface the lamp is the greater the energy loss in accordance with the inverse square law.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. Apparatus for curing a photocurable material applied to a floor surface, comprising a carriage having wheels;

a source of curing light greater than about 75 watts per inch carried by the carriage including a UV source lamp positioned within a focusing reflector to concentrate the UV emitted the lamp toward a floor;

an electronic ballast circuit selectively energizing said light source to cause instant strike of the light source to the floor surface; and the apparatus being free of a shutter that would selectively cover the source of curing light.

2. An apparatus as claimed in claim 1 wherein the carriage has a shroud around the light source extending downward from the carriage toward the floor surface to be cured to mask light from escaping sideways from the apparatus.

3. An apparatus as claimed in claim 1 wherein the carriage has a motor to drive the wheels and a selectively actuable clutch to enable the wheels to be free wheeling when the clutch is not engaged.

4. An apparatus as claimed in claim 1 wherein the carriage has an air knife between the source of curing light and the wheels to cool the floor surface before contact by the wheels.

5. An apparatus as claimed in claim 4 wherein the carriage has front wheels and the source of curing light is on a front of the carriage, and the air knife is between the source of curing light and the front wheels.

6. An apparatus as claimed in claim 1 wherein the carriage has primary wheels that support the carriage and contact a floor that is being cured and a supplemental set of wheels that are not in contact with a floor as the floor is being cured, the supplemental set of wheels being positioned on the carriage so that they can be engaged with the floor by tilting the carriage and thereby lifting the carriage and the primary wheels off the floor.

7. An apparatus as claimed in claim 1 wherein the electronic ballast circuit outputs a current to cause instant strike of the light source at room temperature.

8. An apparatus as claimed in claim 1 wherein the electronic state ballast circuit outputs a current to cause instant strike of the light source at light source operating temperature.

9. An apparatus as claimed in claim 1 wherein the source of curing light includes a light fixture and a lamp, the lamp having an elongated tubular section, two 90 degree tubular bends and ceramic fittings at the ends of the bends, the ceramic fittings including a tapered leading end and an annular groove, such that insertion of the tapered end into a housing with a spring clip will open the spring clip and continued insertion will allow the spring clip to close and engage the annular groove.

10. An apparatus as claimed in claim 1 wherein the source of curing light includes a light fixture and a lamp, the lamp having an elongated tubular section, two 90 degree angled end fittings with lead wires passing from the end fitting through a series of ceramic beads, ceramic fittings at the ends of the series of beads, the ceramic fittings including a tapered leading end and an annular groove, such that insertion of the tapered end into a housing with a spring clip will open the spring clip and continued insertion will allow the spring clip to close and engage the annular groove.

11. An apparatus as claimed in claim 1 wherein the carriage has a tilt sensor that turns off the light source if the carriage is tilted.

12. A method of curing a photocurable material applied to a floor surface, comprising moving a carriage having wheels over the floor surface; DRAFT exposing the floor surface to curing light greater than about 75 watts per inch emanating from a light source including a UV source lamp positioned within a focusing reflector to concentrate the UV emitted by the lamp toward a floor carried by the carriage at an operating temperature of at least 600 degrees Celsius;

turning off the light source to stop curing the photocurable material;

turning the light source back an while the light source is still hot; and resuming movement of the carriage over the floor surface to resume curing to the floor surface.

13. A method as claimed in claim 12 wherein moving includes blowing air on the floor to cool the floor after exposure to the curing light and before the floor is contacted by a wheel of the carriage.

14. A method as claimed in claim 12 further comprising adjusting a handle length on a handle of the carriage.

15. A method as claimed in claim 12 further comprising supplying electricity to a ballast for the light source and determining a supplied voltage to selectively apply the voltage to a tap on the ballast according to a determined voltage supply.

16. A method as claimed in claim 12 wherein moving includes determining a suitable speed for the carriage to achieve optimum curing in dependence on a sensed output of the curing light emanating from the light source and providing an output signal to correct for excess speed or insufficient speed.

17. A method as claimed in claim 12 further comprising applying cooling air to the light source for a period of time after turning off the light source until the light source has cooled.

18. A method as claimed in claim 12 further comprising sensing non-movement of the carriage and turning off the light source when the carriage has not moved for a period of time.

19. A method as claimed in claim 12 wherein the carriage is moved by applying a control signal to an electrical motor, thereby driving at least one wheel of the carriage.

20. A method as claimed in claim 12 wherein movement is effected with wireless communication control.

* * * * *

UNITED STATES PATENT AND TRADEMARK OFFICE

CERTIFICATE OF CORRECTION

PATENT NO. : 8,356,573 B1
APPLICATION NO. : 12/409083
DATED : January 22, 2013
INVENTOR(S) : Robert Lesko and Daniel Dayon It is certified that error appears in the above-identified patent and that said Letters Patent is hereby corrected as shown below:

In Column 6, Line 31, after the word includes, "as" should be "a"

In Column 9, Line 17, the word "state" should be deleted

In Column 9, Line 45, the word "DRAFT" should be deleted

Signed and Sealed this
Fifth Day of March, 2013

Teresa Stanek Rea
*Acting Director of the United States Patent and Trademark Office*